US005280856A

United States Patent [19]

Haggerty

[11] Patent Number: 5,280,856

[45] Date of Patent: Jan. 25, 1994

[54] DEBRIS SHIELD APPARATUS

[76] Inventor: John W. Haggerty, 125 Guildhall Rd., Rochester, N.Y. 14623

[21] Appl. No.: 924,761

[22] Filed: Aug. 4, 1992

[51] Int. Cl.[5] ..... B05B 1/28

[52] U.S. Cl. ..... 239/288.5; 239/288; 239/583; 239/DIG. 21

[58] Field of Search ..... 239/288, 288.3, 288.5, 239/DIG. 21, DIG. 22, 583

[56] References Cited

U.S. PATENT DOCUMENTS

| | | | |
|---|---|---|---|
| 2,566,878 | 9/1951 | Fahrenkrog et al. | 239/288.5 |
| 2,597,573 | 5/1952 | De Groff | 239/288 |
| 3,129,892 | 4/1964 | Tillman | 239/DIG. 22 |
| 4,124,164 | 11/1978 | Bachman | 239/DIG. 22 |
| 4,865,257 | 9/1989 | Bailey | 239/288.5 |
| 5,170,943 | 12/1992 | Artzberger | 239/DIG. 21 |

FOREIGN PATENT DOCUMENTS

| | | | |
|---|---|---|---|
| 198801 | 6/1923 | United Kingdom | 239/288.5 |

*Primary Examiner*—David M. Mitchell
*Assistant Examiner*—Christopher G. Trainor
*Attorney, Agent, or Firm*—Leon Gilden

[57] ABSTRACT

An arcuate shield having a concave interior surface is formed as a semi-conical configuration having first and second side edges converging towards a forward edge. The shield structure is arranged to mount a pneumatic hose medially and in contiguous communication with an inner concave surface of the shield. A modification of the invention further includes fan blades arranged for mounting adjacent a rear edge of the shield structure to enhance coverage of the shield, as well as providing for adjustment to modify the arcuate configuration of the shield structure to afford adjustment of the confronting surface of the shield structure.

2 Claims, 6 Drawing Sheets

DEBRIS SHIELD APPARATUS

BACKGROUND OF THE INVENTION

1. Field of the Invention

The field of invention relates to shield apparatus, and more particularly pertains to a new and improved debris shield apparatus wherein the same is arranged to deflect debris relative to pneumatic hoses.

2. Description of the Prior Art

The use of pneumatic hoses in various cleaning procedures effects the scattering of various airborne particles. To afford protection to an operator, the instant invention provides for a convenient and readily mounted structure relative to a pneumatic hose structure. Pneumatic nozzles of various types are directed in the prior art and exemplified in U.S. Pat. No. 4,842,203 to Kohn.

The U.S. Pat. No. 4,867,380 to Sibbersten sets forth a compressed air blower structure typically utilized in a cleaning type procedure.

As such, it may be appreciated that there continues to be a need for a new and improved debris shield apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of shield apparatus now present in the prior art, the present invention provides a debris shield apparatus wherein the same is directed to a semi-conical shield structure mounted to a pneumatic hose conduit. As such, the general purpose of the present invention, which will be described subsequently in greater detail, is to provide a new and improved debris shield apparatus which has all the advantages of the prior art shield apparatus and none of the disadvantages.

To attain this, the present invention provides an arcuate shield having a concave interior surface formed as a semi-conical configuration with first and second side edges converging towards a forward edge. The shield structure is arranged to mount a pneumatic hose medially and in contiguous communication with an inner concave surface of the shield. A modification of the invention further includes fan blades arranged for mounting adjacent a rear edge of the shield structure to enhance coverage of the shield, as well as providing for adjustment means to modify the arcuate configuration of the shield structure to afford adjustment of the confronting surface of the shield structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved debris shield apparatus which has all the advantages of the prior art shield apparatus and none of the disadvantages.

It is another object of the present invention to provide a new and improved debris shield apparatus which may be easily and efficiently manufactured and marketed.

It is a further object of the present invention to provide a new and improved debris shield apparatus which is of a durable and reliable construction.

An even further object of the present invention is to provide a new and improved debris shield apparatus which is susceptible of a low cost of manufacture with regard to both materials and labor, and which accordingly is then susceptible of low prices of sale to the consuming public, thereby making such debris shield apparatus economically available to the buying public.

Still yet another object of the present invention is to provide a new and improved debris shield apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its vises, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
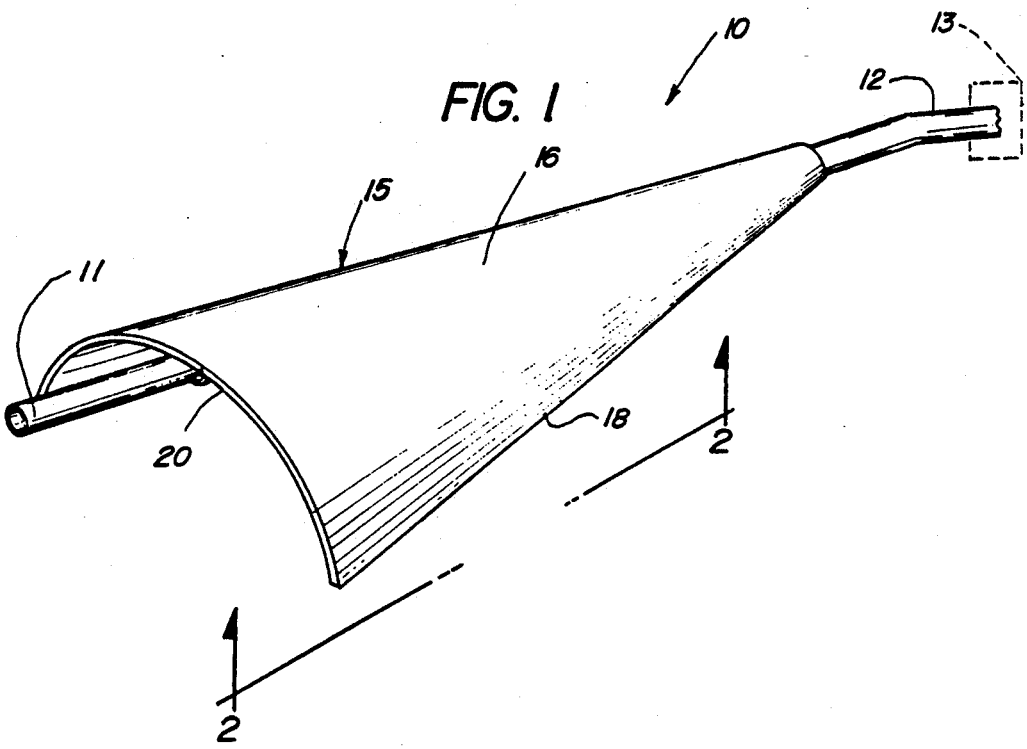
FIG. 1 is an isometric illustration of the instant invention.
Figure 2:
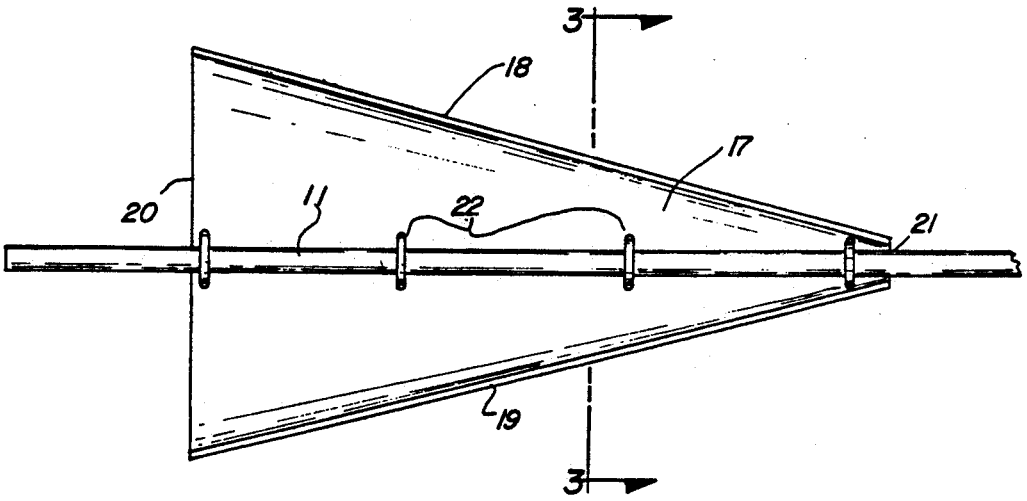
FIG. 2 is an orthographic view, taken along the lines 2—2 of FIG. 1 in the direction indicated by the arrows.
Figure 3:
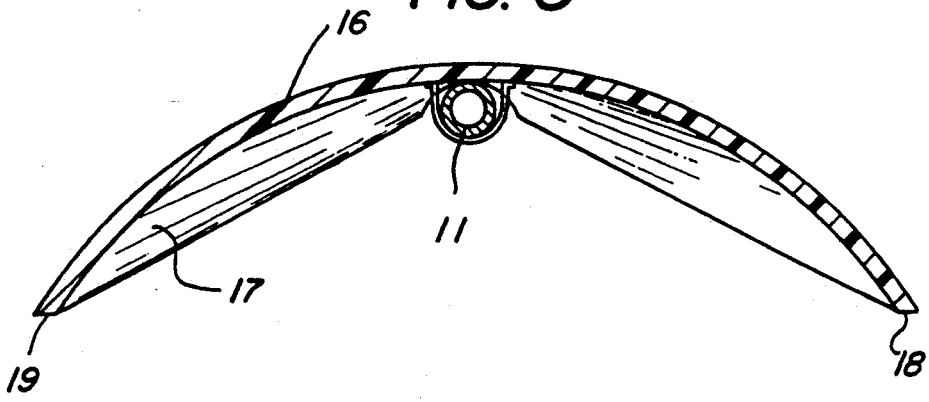
FIG. 3 is an orthographic view, taken along the lines 3—3 of FIG. 2 in the direction indicated by the arrows.
Figure 4:
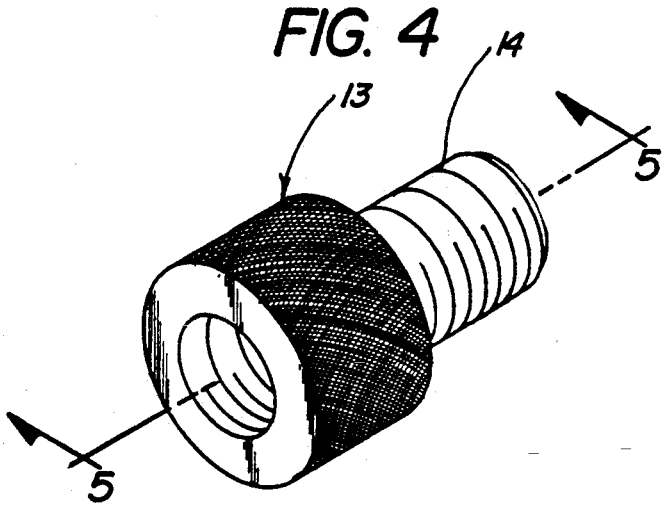
FIG. 4 is an isometric illustration of an adapter nozzle utilized by the invention.
Figure 5:
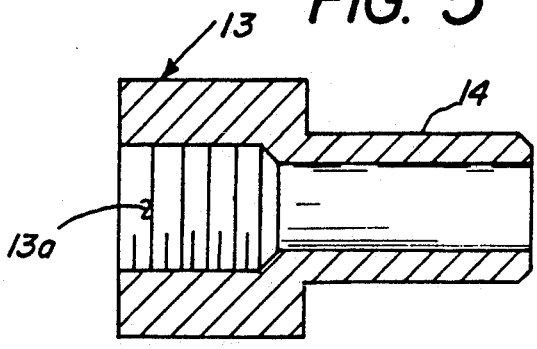
FIG. 5 is an orthographic view, taken along lines 5—5 of FIG. 4 in the direction indicated by the arrows.

With reference now to the drawings, and in particular to FIGS. 1 to 13 thereof, a new and improved debris shield apparatus embodying the principles and concepts of the present invention and generally designated by the reference numerals 10, 10*a*, and 10*b* will be described.

More specifically, the debris shield apparatus 10 of the instant invention essentially comprises a pneumatic conduit 11 of rigid construction having a forward end 12 mounting an adapter nozzle 13 thereto. The adapter nozzle includes an internally threaded nozzle conduit 13*a* to receive an externally threaded forward distal end of the pneumatic conduit 11, with the nozzle further including a forward externally threaded tubular shank 14 in pneumatic, communication with the nozzle conduit 13*a* for accommodating various pneumatic tools thereon.

The shield structure 15 defines a truncated semi-conical shield plate 15 having a convex outer surface 16 and a concave inner surface 17. A first side edge 18 and a second side edge 19 converge towards the arcuate forward edge 21 of the shield that is spaced from and parallel the arcuate rear edge 20. A plurality of fastening loops 22 mounted medially fin the inner surface 17 secures the pneumatic conduit thereto.

Figure 6:
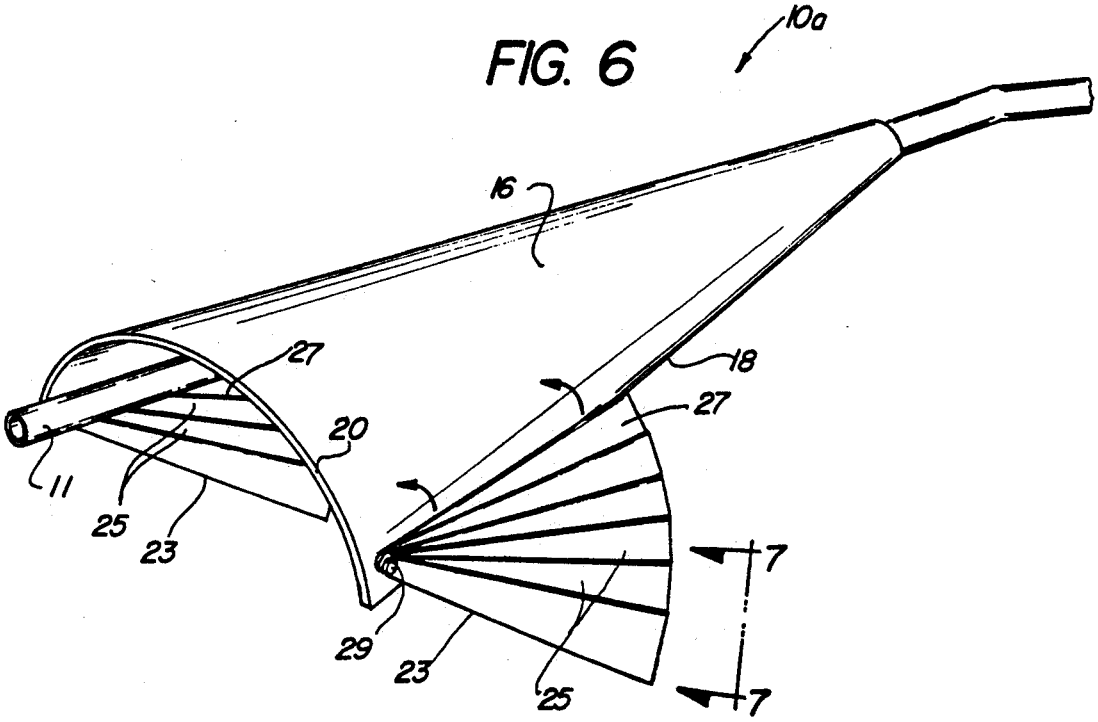
FIG. 6 is an isometric illustration of a modification of the invention.
Figure 7:
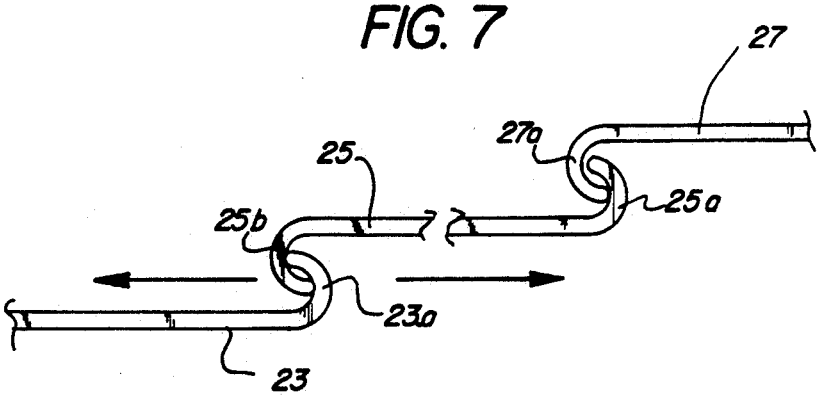
FIG. 7 is an orthographic view, taken along the lines 7—7 of FIG. 6 in the direction indicated by the arrows.
Figure 8:
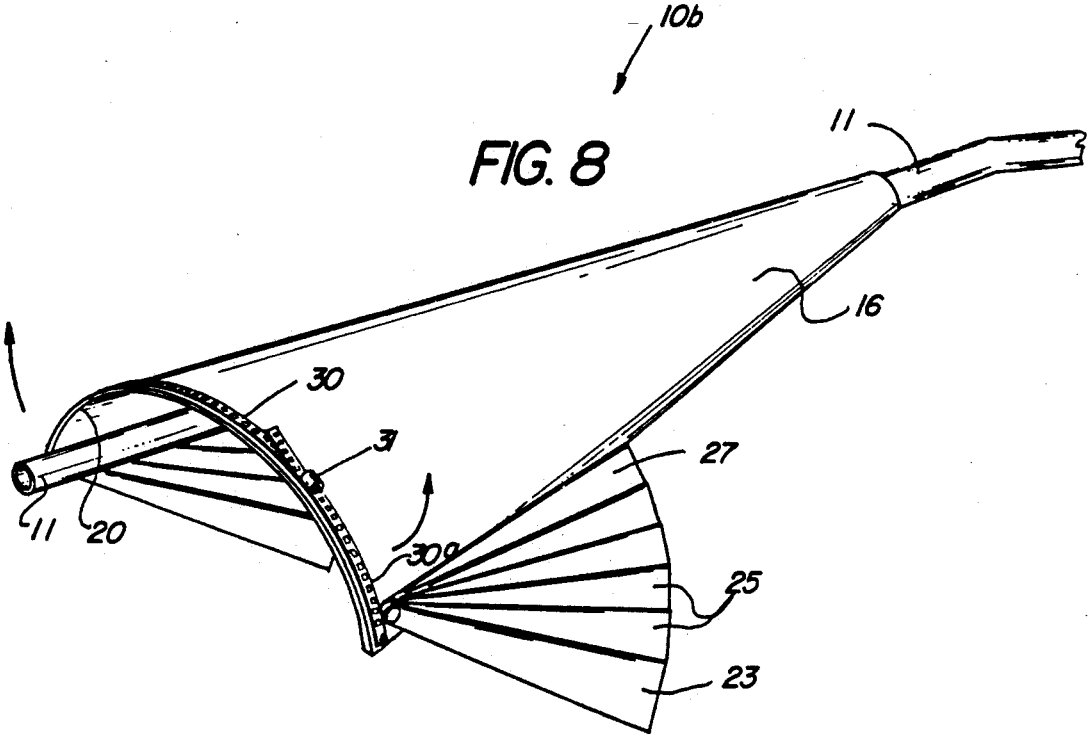
FIG. 8 is an isometric illustration of a further aspect of the invention.
Figure 9:
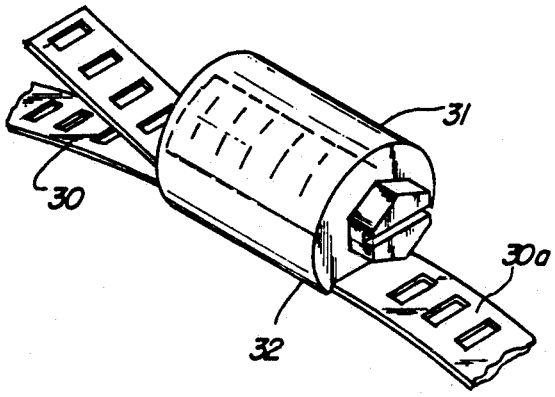
FIG. 9 is an enlarged isometric illustration of the worm drive housing mounted to the associated adjuster web.

The FIG. 6 illustrates the use of plural sets of fan blades mounted pivotally adjacent intersections of the first and second side edges 18 and 19 with the arcuate rear edge 20, Each set of fan blades includes an outer fan blade 23 having an outer fan blade u-shaped side wall 23*a*. Intermediate blades 25 include respective u-shaped first ant second side walls 25*a* and 25*b*. A triangular anchor blade 27 is mounted to the outer surface 16 and includes an anchor blade U-shaped side wall 27*a*. The U-shaped side wall 27*a* is arranged for communication with a first side wall 25*a*, with the intermediate blade second side wall 25*b* arranged for communication with an adjacent side wall. The outer blade 23 has its outer blade U-shaped side wall 23*a* engaged with an adjacent intermediate second side wall 25*b*. The intermediate blades, as well as the inner and outer blades, are each of an isosceles triangular configuration having its apex secured about the blade's pivot axle 29. In this manner, the blades may be expanded to afford greater protection to an operator during use of the structure.

A slotted adjuster web 30 is fixedly mounted to the convex outer surface 16 adjacent the rear edge 20 cooperative with a further adjuster web 30*a* that extends from the first side edge 18 along the rear edge 20. It should be noted that the adjuster web 30 extends from the second side edge along the rear edge, wherein the adjuster web 30 and the further adjuster web 30*a* are arranged for engagement relative to one another as the further adjuster web 30*a* is directed through the worm drive housing 31, with the adjuster web 30 fixedly mounted to the worm drive housing. Upon rotation of the worm screw 32, the further adjuster web is arranged for displacement relative to the adjuster web to effect a flattening of the shield 15 to provide for arcuate adjustment of the shield and thereby provide for varying degrees of deflection of the shield structure relative to a work site.

Figure 10:
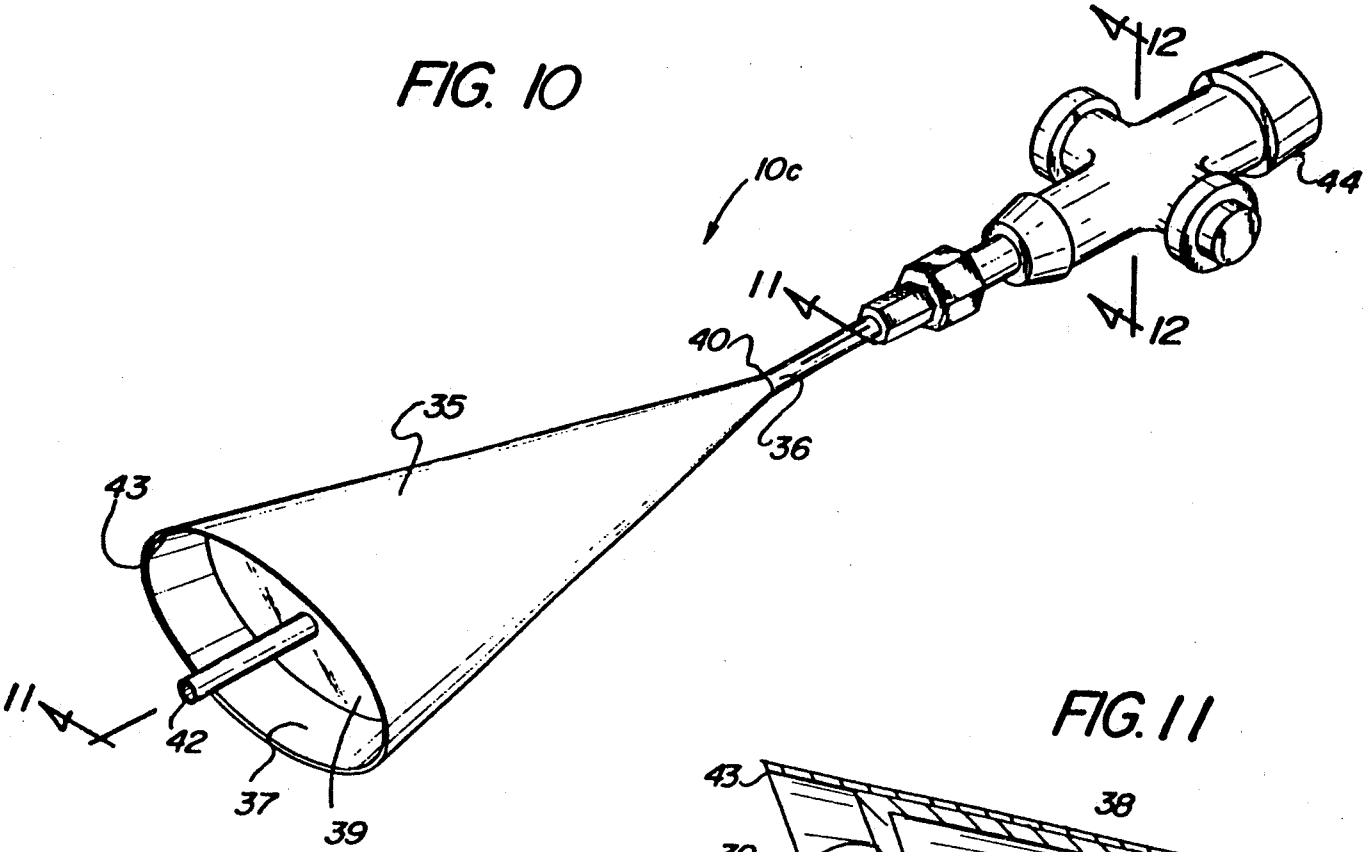
FIG. 10 is an isometric illustration of a yet further aspect of the invention.
Figure 11:
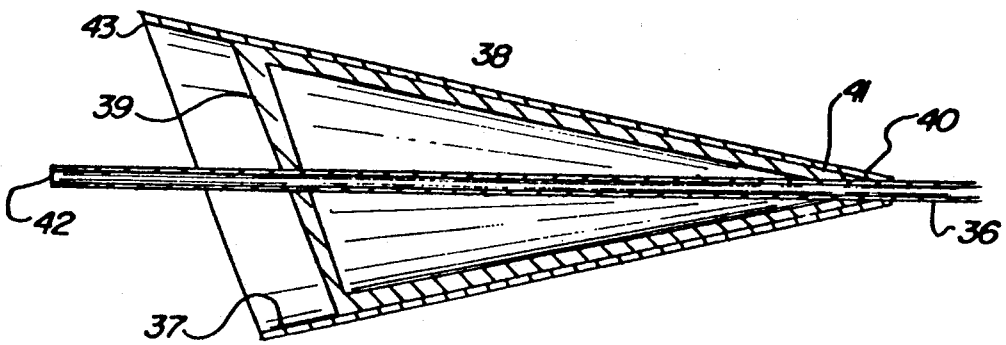
FIG. 11 is an orthographic view, taken along the lines 11—11 of FIG. 10 of the direction indicated by the arrows.

A yet further aspect of the invention 10*c*, as indicated in the FIGS. 10 and 11, employing a pneumatic tube 36 directed from a source of compressed air, with the pneumatic tube 36 directed through a conical shield 35 that is arranged with a conical shield entrance opening edge 43 and a conical shield apex 40. The conical shield-35 is defined with a conical shield interior surface 37 having a conical defector 38 mounted fixedly therewithin, wherein the conical deflector 38 includes a conical deflector apex 41 coincident with the conical shield apex 40, and a conical shield deflector bottom wall 39 arranged in a spaced relationship relative to the conical shield entrance opening edge 43. The conical deflector 38 is typically formed of lead material, with the conical shield 35 typically formed of material such as copper and the like. In this manner, debris directed into the conical shield 35 impinges upon the conical deflector bottom wall 39 to thereby minimize ricochet and deflection of debris directed into the shield structure. Further, the conical construction of the shield 38 is arranged to maintain alignment of the pneumatic tube 42 as it is directed through the conical deflector bottom wall 39 while providing required and necessary balance to the manually grasped organization.

Figure 12:
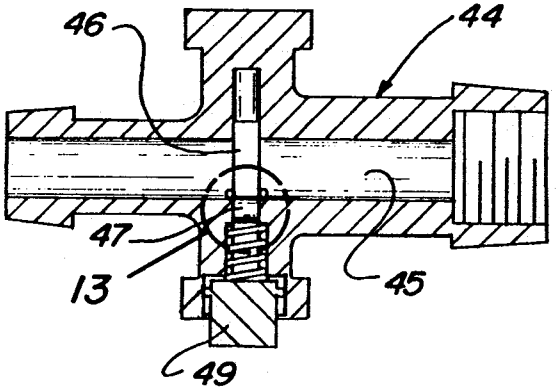
FIG. 12 is an orthographic view, taken along the lines 12—12 of FIG. 11 in the direction indicated by the arrows.
Figure 13:
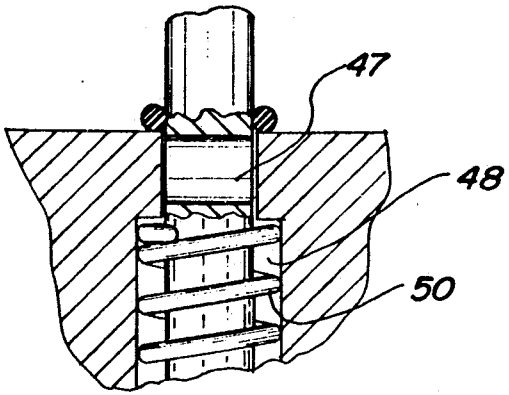
FIG. 13 is an enlarged orthographic view of section 13 as set forth in FIG. 12.

A valve member 44 employed by the invention, as indicated in FIG. 12, is formed with a valve conduit 45 directed therethrough, having a plunger 46 directed into the valve member 44 in an orthogonal orientation relative to the conduit 45. A plunger port 47 through the plunger 46 is normally spaced from the valve conduit 45, but is arranged for projection therewithin as the plunger 46 is reciprocatably mounted within a valve member cavity 48 having a floor and a valve spring 50 captured between the cavity floor and the plunger cap 49.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Farther, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A debris shield apparatus comprising, a conical shield, the conical shield including a shield apex and a shield interior surface, the conical shield further having an annular continuous conical shield entrance opening edge, and a pneumatic tube directed through the conical shield and the conical shield apex and projecting beyond the conical shield entrance opening edge, and the conical shield interior surface includes a conical deflector in contiguous communication therewith, the conical deflector having a conical deflector apex coincident with the conical shield apex directing the pneumatic tube therethrough, and the conical deflector having a conical deflector bottom wall, the pneumatic tube directed through the bottom wall and the conical deflector bottom wall fixedly mounted within the conical shield in a spaced relationship relative to the conical shield entrance opening edge.

2. An apparatus as set forth in claim 1 including a valve member, the valve member having pneumatic communication with the pneumatic tube and the valve member including a valve member conduit in pneumatic communication with the pneumatic tube, and the valve member having a plunger reciprocatably mounted within the valve member, the plunger having a plunger port spaced from the valve member conduit in a first position and directed into the valve member conduit in a second position, the plunger including a plunger cup, and the plunger mounted within a valve member cavity within the valve member, the cavity having a cavity floor and a spring captured between the cavity and the cup to bias the plunger in the first position.

* * * * *